US010549149B1

(12) United States Patent
Long

(10) Patent No.: US 10,549,149 B1
(45) Date of Patent: Feb. 4, 2020

(54) BALANCE BOARD ROTATIONAL WEIGHTED RESISTANCE TRAINER

(71) Applicant: Michael Ray Long, Ventura, CA (US)

(72) Inventor: Michael Ray Long, Ventura, CA (US)

( * ) Notice: Subject to any disclaimer, the term of this patent is extended or adjusted under 35 U.S.C. 154(b) by 13 days.

(21) Appl. No.: 15/997,430

(22) Filed: Jun. 4, 2018

Related U.S. Application Data

(60) Provisional application No. 62/515,957, filed on Jun. 6, 2017.

(51) Int. Cl.
*A63B 22/16* (2006.01)
*A63B 21/06* (2006.01)
*A63B 21/00* (2006.01)

(52) U.S. Cl.
CPC ..... *A63B 22/16* (2013.01); *A63B 21/0602* (2013.01); *A63B 21/0603* (2013.01); *A63B 21/0605* (2013.01); *A63B 21/0615* (2013.01); *A63B 21/4034* (2015.10)

(58) Field of Classification Search
None
See application file for complete search history.

(56) References Cited

U.S. PATENT DOCUMENTS 3,984,100 A 10/1976 Firster
4,491,318 A 1/1985 Francke
4,640,509 A 2/1987 Manspeaker
4,759,542 A 7/1988 Hudec
4,826,159 A 5/1989 Hersey
5,062,629 A 2/1991 Vaughan
5,152,691 A 10/1992 Moscarello
5,310,395 A 5/1994 Ko
5,584,787 A 12/1996 Guidry
5,643,154 A 7/1997 Awbrey et al.
5,647,830 A 7/1997 Togao
5,897,474 A 4/1999 Romero
6,019,712 A 2/2000 Duncan
6,168,551 B1 * 1/2001 McGuinness ..... A63B 69/0093 434/247
6,422,983 B1 * 7/2002 Weck ..... A63B 21/0004 482/146
6,705,977 B1 3/2004 Ziak
6,945,920 B1 9/2005 Kemery et al.
7,479,096 B2 1/2009 Saikawa
7,566,291 B2 * 7/2009 Lickle ..... A63B 26/003 482/146
7,775,952 B1 * 8/2010 Curran ..... A63B 22/18 482/146

(Continued)

*Primary Examiner* — Stephen R Crow
(74) *Attorney, Agent, or Firm* — Sandy Lipkin

(57) ABSTRACT

A resistance trainer that provides for rotational movement, balance training and strength building. The device is an integral one-piece fabricated from wood or plastic that includes a deck that is detachable from the base. The base in includes two separate dome-shaped reservoirs wherein the domes provide instability when in contact with the ground due to the curved surface. Inside of the domed reservoirs is space to add a weighted component, such as standard plate weights or sand or water or other replaceable means of weighting the device. The user can rotate the board using the torso muscles used when surfing or snowboarding and can also balance in a heel to toe direction or a front to back direction for balance and strength building.

17 Claims, 3 Drawing Sheets

(56) References Cited

U.S. PATENT DOCUMENTS

| | | | | |
|---|---|---|---|---|
| 8,734,308 | B1 * | 5/2014 | Joslin | A63B 22/16 482/142 |
| 9,044,634 | B2 | 6/2015 | Hjelt et al. | |
| 9,387,363 | B1 | 7/2016 | Polinsky | |
| 2004/0014571 | A1 * | 1/2004 | Haynes | A63B 21/0004 482/142 |
| 2004/0023766 | A1 * | 2/2004 | Slone | A63B 22/18 482/146 |
| 2004/0198573 | A1 | 10/2004 | Brydson et al. | |
| 2004/0224824 | A1 | 11/2004 | Lickle | |
| 2005/0101441 | A1 | 5/2005 | Rosborough | |
| 2006/0211553 | A1 | 9/2006 | Cantor | |
| 2007/0027010 | A1 | 2/2007 | Tsai | |
| 2007/0270296 | A1 * | 11/2007 | Caldicott | A63B 22/14 482/146 |
| 2008/0020856 | A1 | 1/2008 | Rosa | |
| 2009/0215342 | A1 | 8/2009 | Sannes et al. | |
| 2010/0304941 | A1 | 3/2010 | Ota | |
| 2010/0285941 | A1 | 5/2010 | Vanburen | |
| 2013/0123077 | A1 | 5/2013 | Dunegan | |
| 2013/0178346 | A1 * | 7/2013 | Lin | A63B 22/16 482/146 |
| 2013/0252792 | A1 | 9/2013 | Brown | |
| 2013/0296147 | A1 | 11/2013 | Cruz | |
| 2014/0228187 | A1 | 8/2014 | Moscarello | |
| 2015/0038305 | A1 | 2/2015 | Brown | |
| 2015/0190679 | A1 | 7/2015 | Carbonne et al. | |
| 2015/0251056 | A1 | 9/2015 | Crist | |
| 2017/0095696 | A1 | 4/2017 | Olsen | |

* cited by examiner

BALANCE BOARD ROTATIONAL WEIGHTED RESISTANCE TRAINER

REFERENCE TO PRIOR APPLICATION

This application claims priority of the provisional patent application 62/515,957, filed Jun. 6, 2017 entitled BALANCE BOARD ROTATIONAL MOVEMENT, WEIGHTED, RESISTANCE TRAINER by Mike Ray Long.

BACKGROUND OF THE INVENTION

Field of the Invention

The field of this invention relates generally to the field of resistance trainers and more specifically toward a weight, rotational balance board that provides resistance for specific body parts which need strengthening for rotational, balancing athletic activities such as surfing or snowboarding wherein the training can occur outside of the context of a surfing or snowboarding environment, i.e., out of the water and off of the mountain.

Description of the Prior Art

Balance sports, such as surfing and snowboarding require a great deal of rotational strength in additional to balance. A difficulty in developing the strength needed to perform these activities is that there is little outside of the context of the activity itself that provides the conditioning and strength training required. As a result, a person seeking to strengthen the muscles and build balance and coordination is subject to the context of the activity, i.e., the surf or the snowy mountaintop, which are two environments that are not always available for such training due to weather, time and location.

Some prior art methods exist to improve balance for both strengthening and rehabilitative purposes following an injury. Typical prior art balance boards include a top platform that is generally planar that is attached to an unstable bottom, often times a rounded half-sphere upon which the platform needs to balance. The balancing can go around a 360-degree range or can move along a linear plane. Shortcomings in the prior art include the lack of the ability to build rotational strength as well as balance, which is needed for the activities noted above and for general overall fitness.

It is the object of the instant invention to provide a resistance trainer that provides weighted resistance for waist rotational movements as well as heel to toe balance training and front to back balance training and strength building.

SUMMARY OF THE INVENTION

The basic embodiment of the present invention teaches a resistance training device comprising: a substantially planar top deck; a detachable base from said top deck said detachable base further comprising: a first dome-shaped bowl; a second dome-shaped bowl wherein said first and second dome-shaped bowls extend in a direction away from said top deck and wherein said first and second dome-shaped bowls have a first and second hollow interior.

The above embodiment can be further modified by defining that said first and second hollow interiors are filled with a weighted material.

The above embodiment can be further modified by defining that said weighted material are standard weight plates.

The above embodiment can be further modified by defining that said weighted material is sand.

The above embodiment can be further modified by defining that said weighted material is water.

An alternate embodiment teaches a method of increasing balance, core strength and rotational mobility comprising: acquiring a resistance training device, said resistance training device further comprising: a substantially planar top deck; a detachable base from said top deck said detachable base further comprising: a first dome-shaped bowl; a second dome-shaped bowl wherein said first and second dome-shaped bowls extend in a direction away from said top deck and wherein said first and second dome-shaped bowls have a first and second hollow interior; placing said resistance training device on a desired surface; placing the feet of a user on said top deck; and moving said resistance training device into an unbalanced position through manipulation of the user's weight on said top deck and above said first and second dome-shaped bowls.

The above embodiment can be further modified by defining that said resistance training device can be moved in a heel to toe direction of the user.

The above embodiment can be further modified by defining that said resistance training device can be moved in a front and back direction.

The above embodiment can be further modified by defining that said resistance training device can be moved in a rotational direction through the application of pressure to one of said first and second dome-shaped bowls thereby lifting off of said surface said other dome-shaped bowl wherein said resistance training device is now moved into a changed position on said surface.

The above embodiment can be further modified by defining that said surface is smooth such as a polished floor.

The above embodiment can be further modified by defining that said surface provides friction to said dome-shaped bowls, such as a carpet.

The above embodiment can be further modified by defining that said surface is planar.

The above embodiment can be further modified by defining that said surface is angled.

The above embodiment can be further modified by defining that said first and second hollow interiors of said dome-shaped bowls of said resistance training device are filled with a weighted material.

The above embodiment can be further modified by defining that said weighted material are standard weight plates.

The above embodiment can be further modified by defining that said weighted material is sand.

The above embodiment can be further modified by defining that said weighted material is water.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
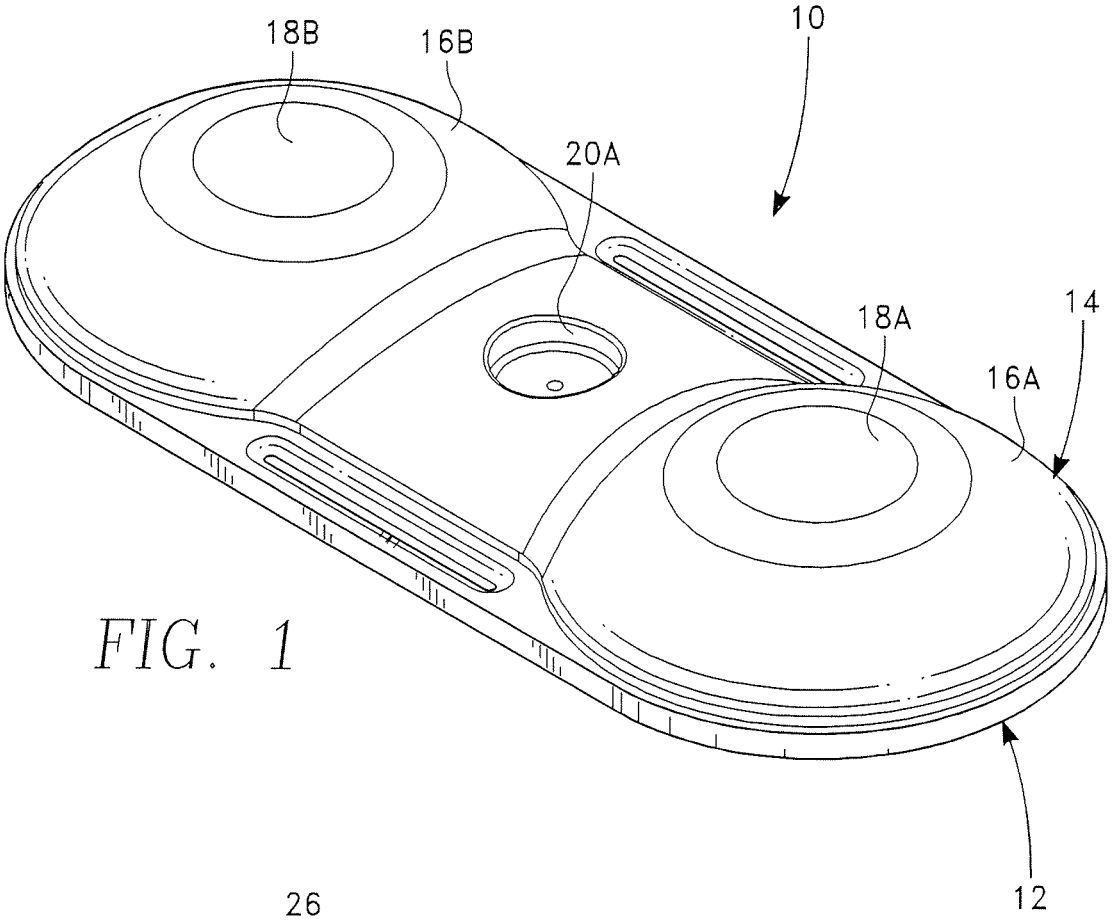
FIG. 1 is a bottom perspective view of the resistance balance trainer of the instant invention.

Turning to the drawings, the preferred embodiment is illustrated and described by reference characters that denote similar elements throughout the several views of the instant invention.

The preferred embodiment of the instant invention provides for a weighted rotational resistance balance trainer 10 that helps to develop specific board sport skill and strength that is difficult to achieve out of the water or off the top of a mountain. The device 10 is a portable device that can be used on a flat surface or an inclined surface to simulate the movements used while riding a wave or boarding down a snow-capped mountain. The user places his or her feet on the top deck 12 which is substantially planar and sized big enough to provide an easy comfortable spread leg stance by the user.

Figure 5:
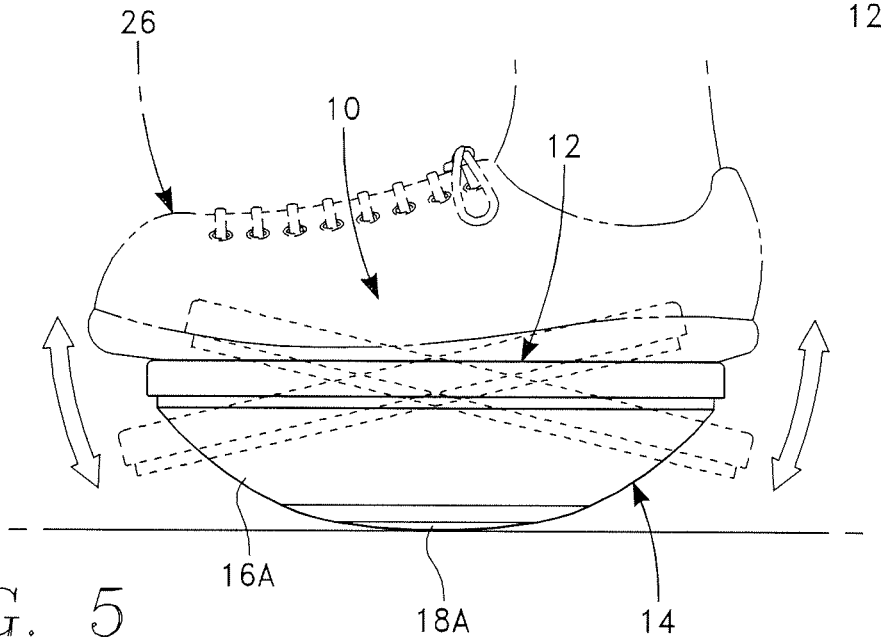
FIG. 5 is a side view of the resistance balance trainer of the instant invention with a user's foot the deck in use.
Figure 2:
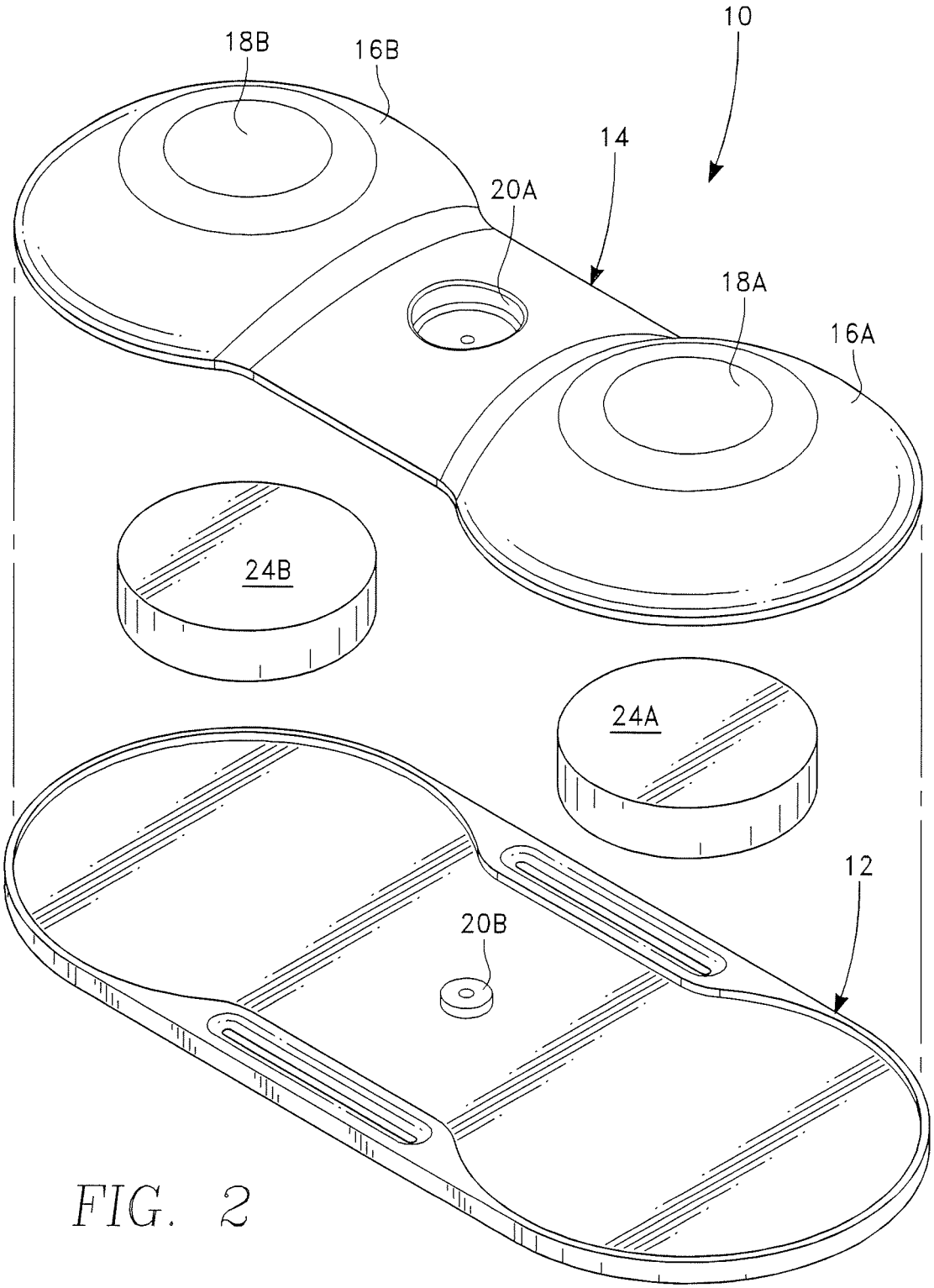
FIG. 2 is an exploded bottom perspective view of the resistance balance trainer of the instant invention.
Figure 3:
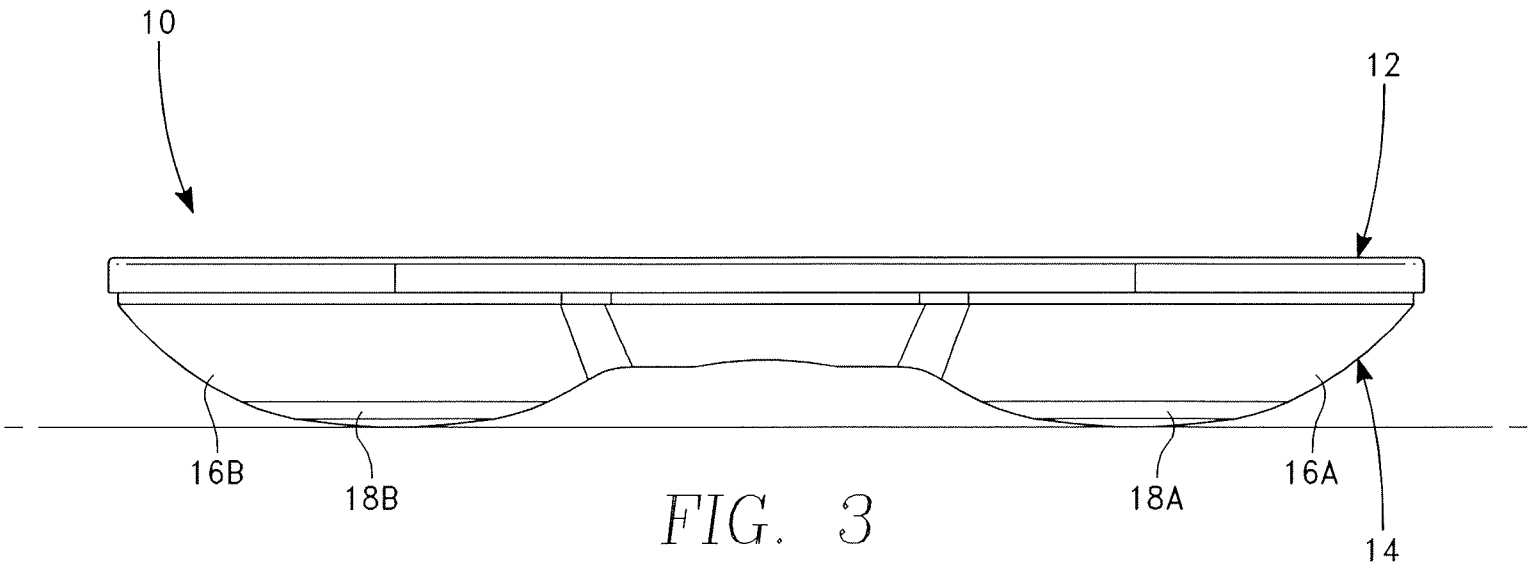
FIG. 3 is a side view of the resistance balance trainer of the instant invention.
Figure 4:
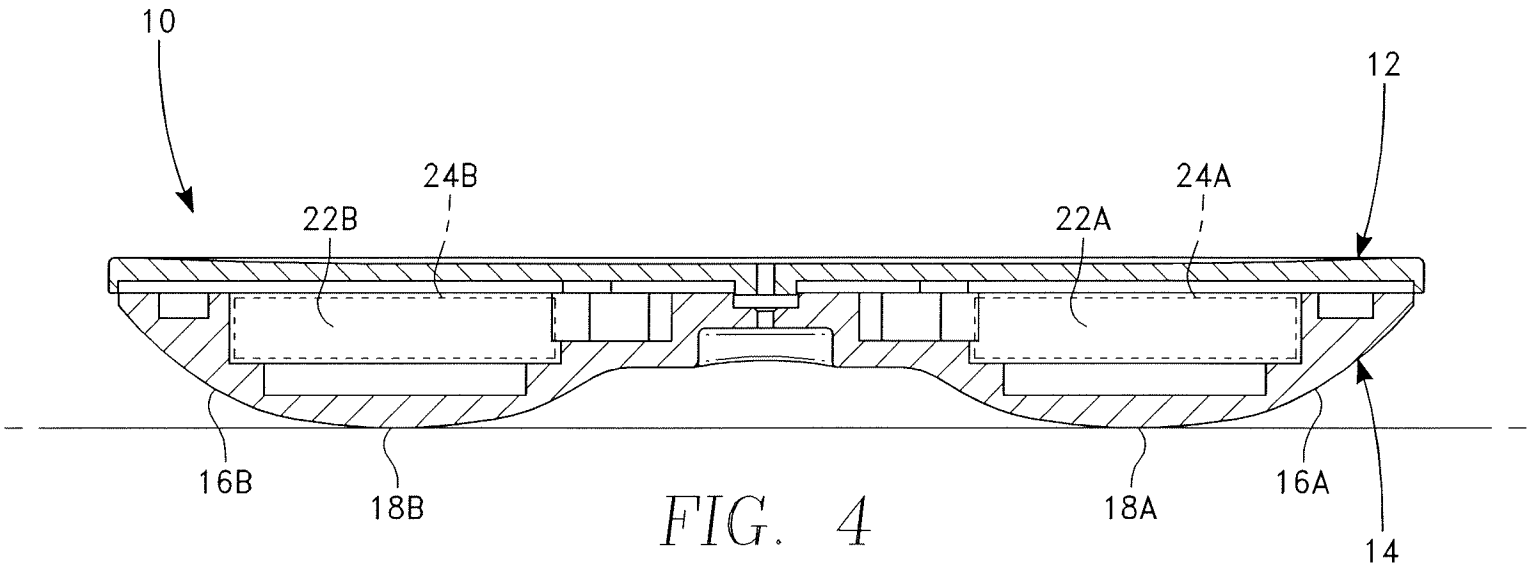
FIG. 4 is a cross-sectional side view of the resistance balance trainer of the instant invention.

The deck 12 is secured to a detachable base 14 that includes two parallel dome-shaped bowls 16A, 16B that contact the surface on which it is used. (See FIG. 2) These dome-shaped bowls 16A, 16B provide the curved surface 18A, 18B that allows for rotational movement when pressure is applied from the top deck 12 by the user's feet 26. (See FIG. 5.) The detachable base 14 is easily removed from the deck 12 through a center screwing mechanism 20A, 20B. Once the deck 12 and base 14 are separated, the two reservoirs 22A, 22B are exposed and can be filled with a weighted component 24A, 24B to provide stability to one side as well as resistance to the side being lifted by the user's feet 26 during use. (See FIG. 4) The addition of a weighted component 24A, 24B helps to build strength in the muscles of the body that are required to make turns while riding a wave or boarding on a snowy mountain.

The very act of rotating the two sides of the board requires strength and agility and may be enough resistance for a person just beginning to train these muscles to sufficient strength to be able to ride a surfboard or snowboard. As strength builds, more resistance is added to gain strength in the both through the use of the weighted component 24A, 24B which be standard weight plates used in weight lifting. Further, the reservoirs can be filled with sand, water or any other removable material that can add weight.

Further, the use of weight also increases heel to toe balance and front to back foot balance training and strength building. The device is a solid piece that can be made of wood or plastic through injection molding or custom design. In the illustrative embodiment, the reservoirs 22A, 22B which are bowl-shaped round domes 16A, 16B situated below the top deck 12. The dimensions can vary per custom specification, but a typical device would be about 32 inches long, 14 inches wide and 3 inches thick. To use, the user stands on the deck 12 on the top of the device 10 with one foot over each domed side 16A, 16B. The domes 16A, 16B provide instability due the curved edges 18A, 18B and this instability invites the user to find balance on top of the deck 12.

To use weighted, the user adds the desired weight 24A, 24B inside of the reservoirs 22A, 22B and secures the deck 12 to the base 14 through the center lock 20. The device 10 is then placed on the desired surface, which can be a carpeted surface for less slip or can be put on a smooth surface such as polished floor for added need to find stability and balance. Additionally, a ramp could be used to simulate the incline and decline of a breaking wave or mountainside so that balance can be strengthened in the position the user will find him or herself in while surfing or snowboarding.

The user finds a comfortable stance with legs spread as they would be when performing the surfing or snowboarding activity. One foot should be sitting atop one of the domes 16A, 16B. The user then rotates the front or back of the board 10 around with the same rotational movement from the torso that would be used when surfing or snowboarding. (See FIG. 5.) Heel to toe movements and front to back foot training also add agility and realism to the development of the muscles desired that are needed for proficient riding of a surfboard or snowboard or other analogous sport.

As described, the device 10 is primarily explained as a trainer for specific sports, but the device 10 can also provide a therapeutic and rehabilitative purpose for those suffering from injuries to the associated body parts. Additionally, a user could perform pushups on the deck 12 and more advanced moves of agility such as hand stands.

The invention illustratively disclosed herein suitably may be practiced in the absence of any element which is not specifically disclosed herein.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A resistance training device comprising:

a substantially planar top deck;

a detachable base from said top deck said detachable base further comprising:

a first dome-shaped bowl;

a second dome-shaped bowl wherein said first and second dome-shaped bowls extend in a direction away from said top deck and wherein said first and second dome-shaped bowls have a first and second hollow interior.

2. The resistance training device as defined in claim 1 wherein said first and second hollow interiors are filled with a weighted material.

3. The resistance training device as defined in claim 2 wherein said weighted material are standard weight plates.

4. The resistance training device as defined in claim 2 wherein said weighted material is sand.

5. The resistance training device as defined in claim 2 wherein said weighted material is water.

6. A method of increasing balance, core strength and rotational mobility comprising:

acquiring a resistance training device, said resistance training device further comprising:

a substantially planar top deck;

a detachable base from said top deck said detachable base further comprising:

a first dome-shaped bowl;

a second dome-shaped bowl wherein said first and second dome-shaped bowls extend in a direction away from said top deck and wherein said first and second dome-shaped bowls have a first and second hollow interior;

placing said resistance training device on a desired surface;

placing the feet of a user on said top deck; and moving said resistance training device into an unbalanced position through manipulation of the user's weight on said top deck and above said first and second dome-shaped bowls.

7. The method as defined in claim 6 wherein said resistance training device can be moved in a heel to toe direction of the user.

8. The method as defined in claim 6 wherein said resistance training device can be moved in a front and back direction.

9. The method as defined in claim 6 wherein said resistance training device can be moved in a rotational direction through the application of pressure to one of said first and second dome-shaped bowls thereby lifting off of said surface said other dome-shaped bowl wherein said resistance training device is now moved into a changed position on said surface.

10. The method as defined in claim 6 wherein said surface is smooth such as a polished floor.

11. The method as defined in claim 6 wherein said surface provides friction to said dome-shaped bowls, such as a carpet.

12. The method as defined in claim 6 wherein said surface is planar.

13. The method as defined in claim 6 wherein said surface is angled.

14. The method as defined in claim 6 wherein said first and second hollow interiors of said dome-shaped bowls of said resistance training device are filled with a weighted material.

15. The method as defined in claim 14 wherein said weighted material are standard weight plates.

16. The method as defined in claim 14 wherein said weighted material is sand.

17. The method as defined in claim 14 wherein said weighted material is water.

* * * * *